US005081799A

United States Patent [19]

Kirschner et al.

[11] Patent Number: 5,081,799

[45] Date of Patent: Jan. 21, 1992

[54] BLASTING APPARATUS

[75] Inventors: Lawrence Kirschner, Flanders; Michael S. Lajoie, Basking Ridge, both of N.J.; William E. Spears, Jr., Houston, Tex.

[73] Assignee: Church & Dwight Co., Inc., Princeton, N.J.

[21] Appl. No.: 730,514

[22] Filed: Jul. 12, 1991

Related U.S. Application Data

[63] Continuation of Ser. No. 505,918, Apr. 6, 1990, abandoned.

[51] Int. Cl.[5] ..... B24C 3/00

[52] U.S. Cl. ..... 51/410; 51/427; 51/436; 51/319; 51/321

[58] Field of Search ..... 51/410, 427, 436, 438, 51/319, 320, 321; 222/630, 637, 55; 406/146, 14, 30

[56] References Cited

U.S. PATENT DOCUMENTS

| | | | |
|---|---|---|---|
| 2,729,917 | 1/1956 | Gregory | 51/427 |
| 2,913,281 | 11/1959 | LeBlanc, Jr. | 406/146 |
| 3,201,901 | 8/1965 | Pauli | 51/438 |
| 4,075,789 | 2/1978 | Dremann | 51/438 |
| 4,420,957 | 12/1983 | Weber | 51/438 |
| 4,878,320 | 11/1989 | Woodson | 51/436 |

*Primary Examiner*—M. Rachuba

*Attorney, Agent, or Firm*—Bryan, Cave, McPheeters & McRoberts

[57] ABSTRACT

Conventional industrial pressure blasting apparatus is modified to allow a controlled pressure on the blast pot that is greater than the pressure on the line where the media and air are mixed for conveying the mixture to the nozzle and then to the workpiece. A media control device, with a fixed but readily variable area, is placed between the blast pot and the media/air mixing line to meter the media flow and maintain the pressure differential between the blast pot and the line. This allows control of the media flow when low flow rates, below about 10 pounds per minute, are required.

17 Claims, 3 Drawing Sheets

BLASTING APPARATUS

This is a continuation of U.S. application Ser. No. 505,918 filed Apr. 16, 1990, abandoned.

This invention relates to improved apparatus for directing fine particles in a compressed air stream toward a workpiece.

BACKGROUND OF THE DISCLOSURE

Standard sand blasting equipment consists of a pressure vessel or blast pot to hold particles of a blasting medium such as sand, connected to a source of compressed air by means of a hose and having a means of metering the blasting medium from the blast pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 20–30 pounds per minute. About 1.2 pounds of sand are used typically with about 1.0 pound of air, thus yielding a ratio of 1.20.

When it is required to remove coatings such as paint or to clean surfaces such as aluminum, magnesium, plastic composites and the like, less aggressive abrasives, including inorganic salts such as sodium chloride and sodium bicarbonate, can be used in conventional sand blasting equipment. The medium flow rates required for the less aggressive abrasives is substantially less than that used for sand blasting, and has been determined to be from about 0.5 to about 10.0 pounds per minute, using similar equipment. This requires a much lower medium to air ratio, in the range of about 0.05 to 0.25.

However, difficulties are encountered in maintaining continuous flow at these low flow rates when conventional sand blasting equipment is employed. The fine particles of a medium such as sodium bicarbonate are difficult to convey by pneumatic systems by their very nature. Further, they tend to agglomerate upon exposure to a moisture-containing atmosphere, as is typical of the compressed air used in sand blasting. Flow aids such as hydrophobic silica have been added to the bicarbonate in an effort to improve the flow, but a substantially uniform flow of bicarbonate material to the nozzle has not been possible up till now. Sporadic flow of the blasting media leads to erratic performance, which in turn results in increased cleaning time and even to damage of somewhat delicate surfaces.

Thus it is desired to have a blasting apparatus that can deliver the blast media at a uniform rate that can be controlled in a predictable manner, at flow rates yielding a medium-to-air ratio of between about 0.05 and 0.25 by weight, using a configuration similar to conventional commercially available sand blasting equipment.

SUMMARY OF THE INVENTION

A conventional blasting apparatus is modified to provide a separate source of line air to a blast pot through a pressure regulator to provide a greater pressure in the blast pot than is provided to the conveying hose. This differential pressure is maintained by an orifice having a predetermined area situate between the blast pot and the conveying hose. This orifice provides an exit for the blast medium and a relatively small quantity of air from the blast pot to the conveying hose, and ultimately to the nozzle and finally the workpiece. The differential air pressure, typically operating between 1.0 and 5.0 psi with an orifice having an appropriate area, yields acceptable media flow rates in a controlled manner.

DETAILED DESCRIPTION OF THE INVENTION

In order to feed fine particles of a material such as a bicarbonate having a mean particle size of from 50 to 1000 microns, preferably from about 250 to 300 microns, at a uniform rate, pressures within the blast pot, including the blast hose pressure, must be positive with respect to the nozzle. Pressures are typically in the range of about 20–125 psig.

Since the blast pot and the conveying hose operate at about the same pressure, the flow of blast media in conventional sand blasting equipment is controlled by gravity feed and a metering valve. We found that the blast pot was under a small differential pressure with respect to the blast delivery hose pressure, which fluctuated between positive and negative; the result was that the flow rates of the blast media fluctuated also in response to the differential pressure changes. Further according to the invention, a differential pressure gauge is installed between the delivery hose and the blast pot to monitor the differential pressure directly. The pressure can be closely controlled by means of a pressure regulator at any hose pressure from 10 to 125 psig or higher, depending on the supply air pressure. The present invention eliminates this source of flow rate variation and also modifies conventional equipment to handle blast media at low flow rates of from about 0.5 to 10 pounds per minute, preferably up to about 5 pounds per minute.

The invention will be described by reference to FIG. 1. Although the blast media illustrated is sodium bicarbonate, other blast media such as potassium bicarbonate, ammonium bicarbonate, sodium chloride and other water-soluble salts are meant to be included herein.

Figure 1:
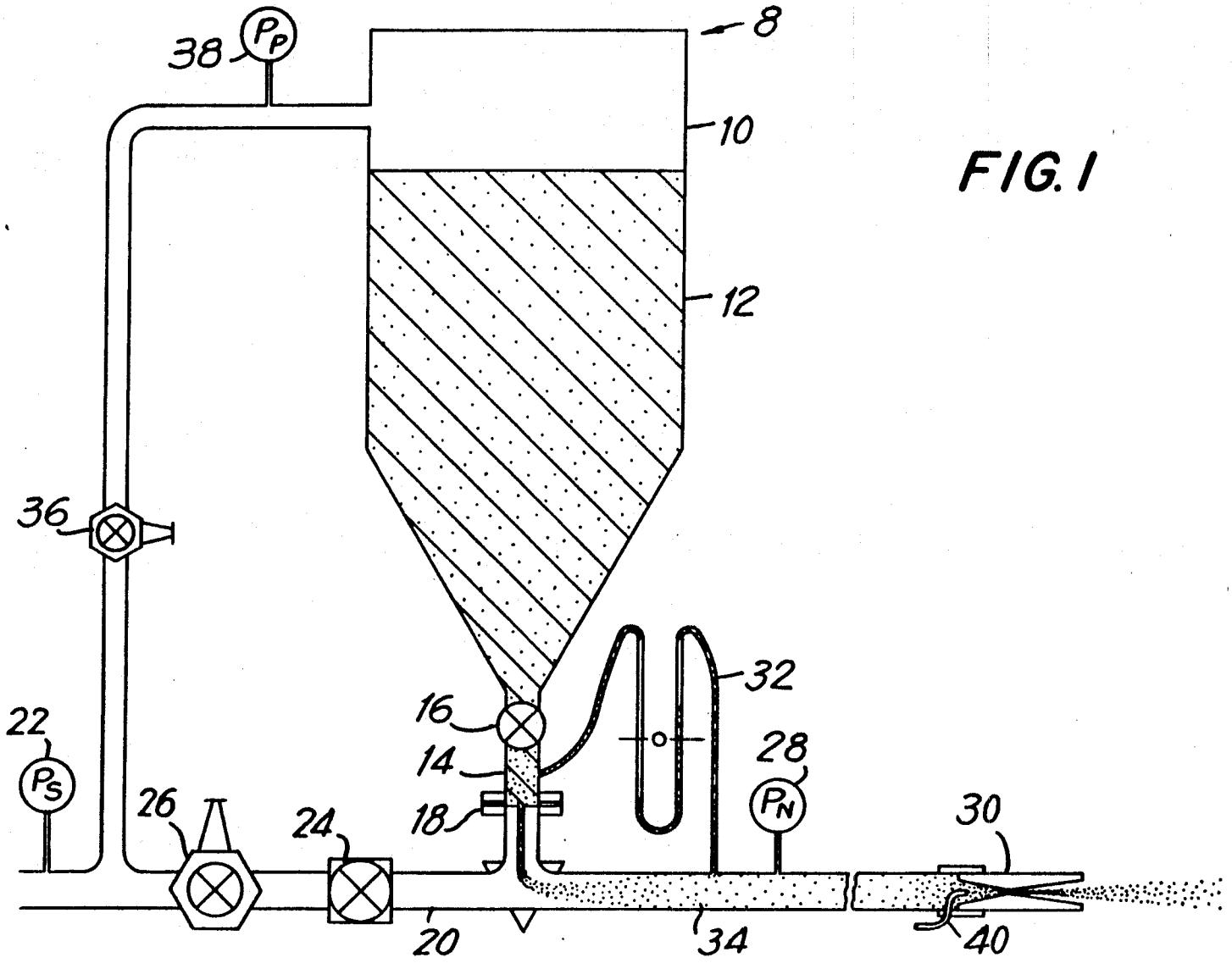
FIG. 1 illustrates a blasting apparatus modified in accordance with the present invention.

Referring to FIG. 1, blast apparatus 8 includes a blast pot 10, partially filled with blast media 12. The blast pot 10, suitably having a cavity of about $6^3$ feet, terminates in a media exit line 14 governed by a valve 16. The medium control area, typically but not limited to an orifice plate 18, further restricts the flow of the media 12 to the desired flow rate. A line 20 is connected to a source of pressurized air (not shown) which is monitored with an inlet monitor 22. Air valve 24 is a remotely operated on/off valve that activates the air flow to the nozzle and the opening and closing of the media cut off valve. Nozzle pressure regulator valve 26 regulates the nozzle pressure by means of a monitor 28 when the system is in operation. Nozzle pressure regulator valve 26 can maintain the desired nozzle pressure. The nozzle pressure monitor 28 enables a controlled pressure to be applied to the nozzle 30, suitably having a throat diameter of about 0.5 inch. The differential pressure gauge 32 monitors the pressure between the blast pot 10 and the conveying hose 34. The pot pressure regulator 36, measured by gauge 38, is used to provide a pressure higher than the pressure in the conveying hose 34, thus allowing the differential pressure to be monitored by differential pressure gauge 32. Optional equipment for protection of and cooling of the workpiece and the control of dust is provided by a water injection line 40, which injects water to the nozzle 30.

In operation, the blast media 12 is fed through media exit line 14 and the valve 16 to an orifice plate 18, which regulates the flow of media to the compressed air line 20. The orifice openings can vary from about 0.063 to about 0.156 inch diameter, or openings corresponding to the area provided by circular orifices of 0.063 to 0.156 inch diameter. Preferably the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig, preferably about 2 to 4 psig, between the media exit line 14 and the conveying hose 34 is maintained at all times. A source of compressed air is also fed to the air line 20, regulated by the valves 24 and 26 to the desired air pressure and nozzle pressure, respectively, which preferably is between about 15 to about 125 psig. The pot pressure regulator 36 controls the pressure to the top of the blast pot 10, further ensuring a controlled and uniform flow of blast media 12. The manometer or other differential pressure gauge 32 measures the differential pressure, which is proportional to the amount of media flowing through the orifice 18. The blast media, compressed air and water are delivered to the nozzle 30 and ejected toward the workpiece (not shown) at a uniform and controllable rate.

A stream of sodium bicarbonate media at a pressure of 64 psig and feed rate of about 2 pounds per minute, nozzle pressures of 60 psig and water pressure of 200 psi, was directed at painted aluminum panels 2 feet by 2 feet by 0.032 inch thick situate 18 inches from the orifice of the nozzle. The panels were depainted and all corrosion products removed in four minutes, with no damage to the aluminum panels.

Figure 2:
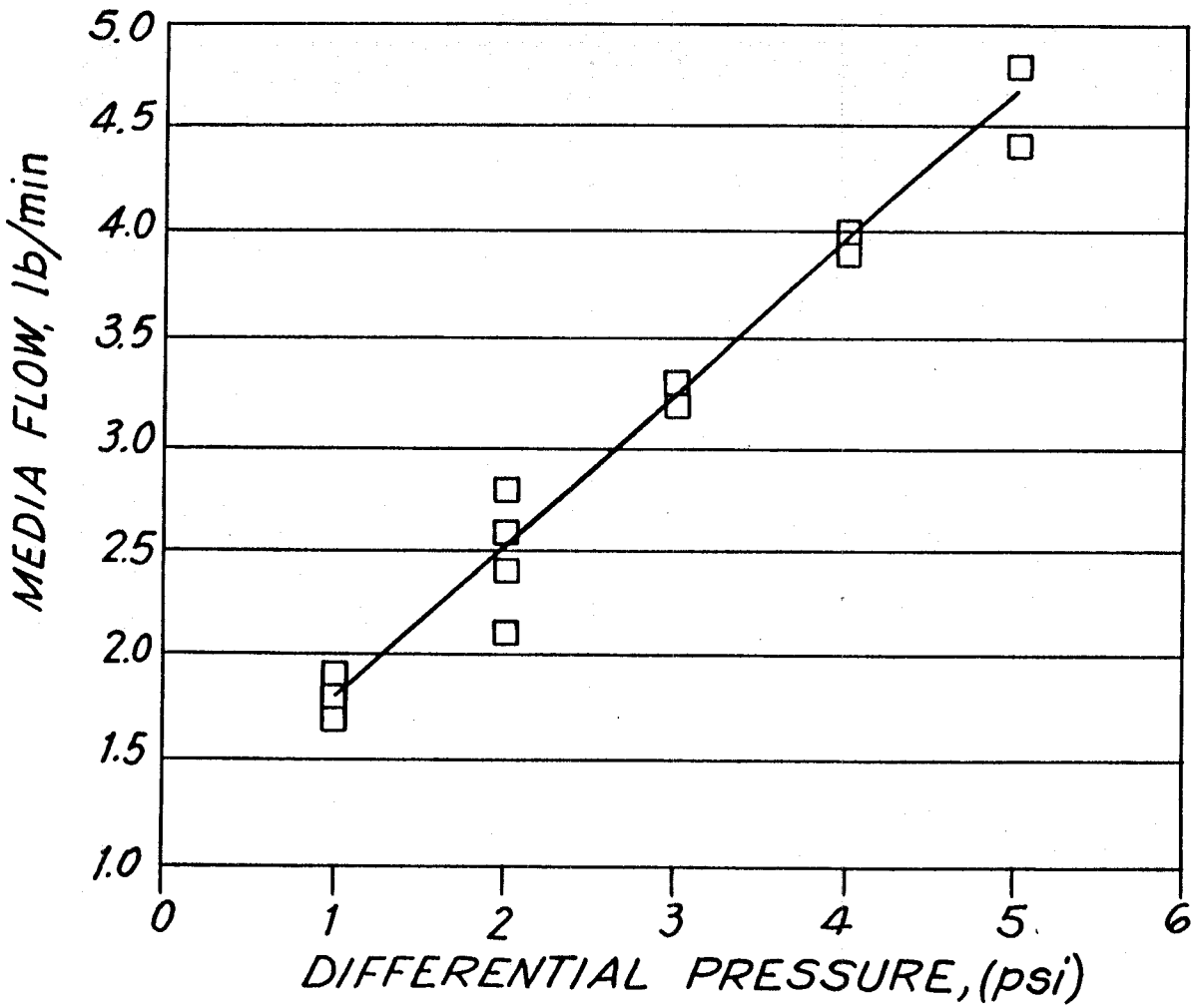
FIGS. 2 and 3 are graphs of media flow rate versus pressure.

FIG. 2 is a graph of media flow rate of from 1 to 5 pounds per minute versus different pressures in psi varying from 1 to 5 psi. The data points were made using a sodium bicarbonate medium having a mean particle size of about 65 microns, a nozzle pressure of 60 psi and an orifice opening of 5/32 inch. It is apparent that the media flow varies linearly with pressure.

Figure 3:
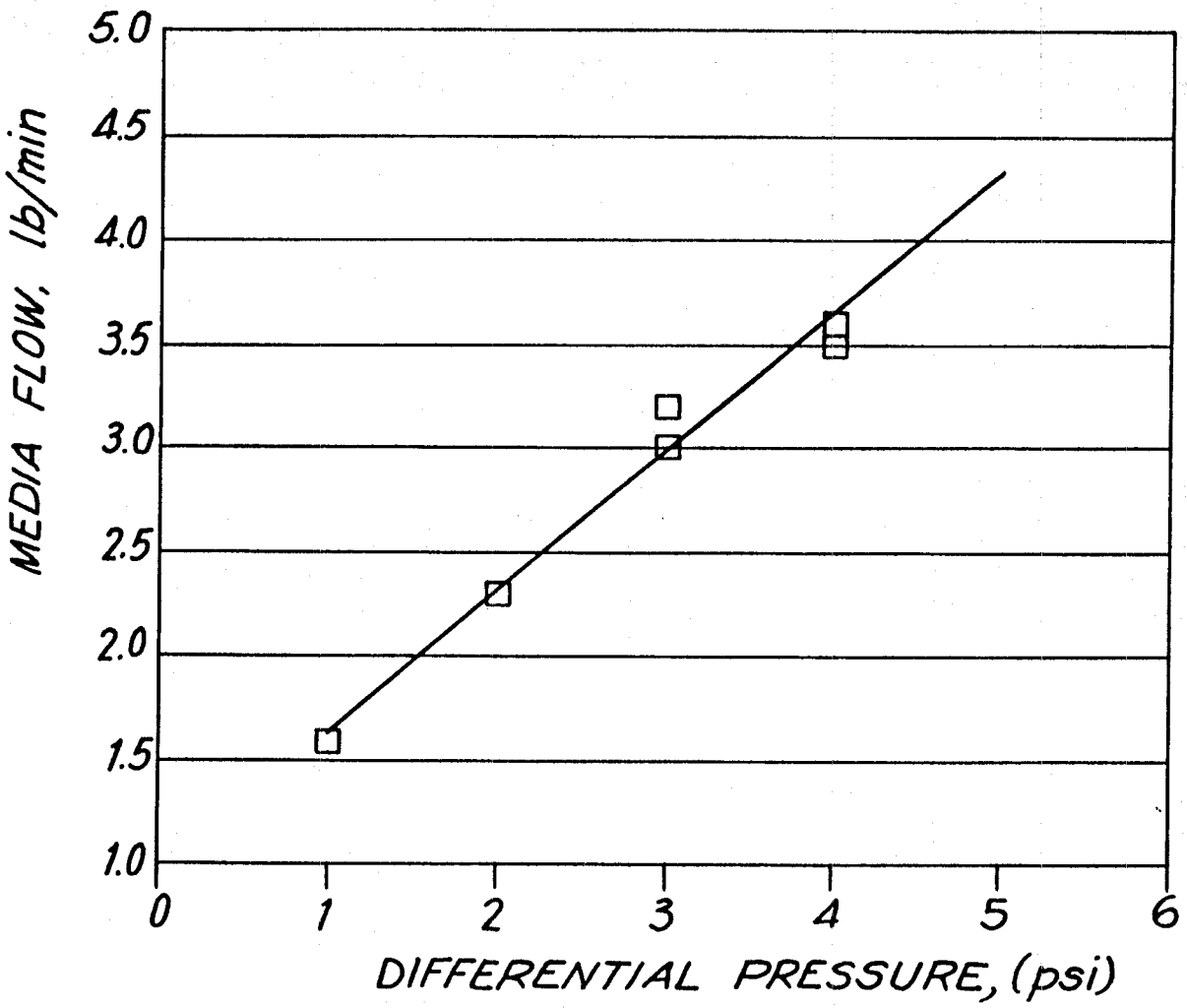

FIG. 3 is a graph of media flow rate in pounds/min versus different pressure in psi using a sodium bicarbonate media having a mean particle size of 250 microns. Again, the media flow varies linearly with different pressures.

The present apparatus has an added benefit in that surface corrosion is removed at the same time as the coating, eliminating separate hand sanding or solvent dissolution techniques. Further, the present apparatus removed paint and other coatings efficiently and effectively from the surface of delicate metal parts, including areas around seams, rivets, screws, and the like, that heretofore required separate, special techniques. The system can be used efficiently and controllably with robotics.

We claim:

1. A method for blasting, comprising the steps of:

containing a quantity of blasting medium comprised of fine particles having a mean particle size of from about 50 to 1000 microns within a pressure vessel;

pressurizing said pressure vessel by providing fluid communication between said pressure vessel and a source of pressurized air;

feeding said blasting medium from said pressure vessel, through an exit line to a conveying line, said conveying line being in fluid communication with said source of pressurized air through an air line;

passing said blasting medium through a variable size orifice opening positioned in said exit line, said orifice opening being adjustable to predetermined areas which restrict the flow of said blasting medium to regulate the flow rate consistent with the particle size of said blasting medium;

mixing said blasting medium with the stream of pressurized air flowing within said conveying line;

sensing the pressure in said pressure vessel and said conveying line;

regulating the pressure in said air line and in said conveying line to maintain a pressure differential at a preselected level such that the pressure level within said pressure vessel is greater than the pressure within said conveying line;

discharging said mixture of blasting medium and said stream of pressurized air through a nozzle at the end of said conveying line.

2. The blasting method of claim 1, wherein the blasting medium has a mean particle size of from about 250 to 300 microns.

3. The blasting method of claim 1, wherein the blasting medium is sodium bicarbonate.

4. The blasting method of claim 1, wherein said preselected pressure differential is between 1.0 and 5.0 psig.

5. The blasting method of claim 1, wherein said preselected pressure differential is between 2.0 and 4.0 psig.

6. The blasting method of claim 1, wherein said preselected pressure differential is selected to maintain a uniform flow rate through said nozzle.

7. In a blasting apparatus for delivering a blasting medium comprising fine particles having a mean particle size of from about 50 to 1000 microns, including:

a pressure vessel containing said blasting medium;

a source of compressed air for entraining the blasting medium, in fluid communication with the pressure vessel;

a conveying line, in fluid communication with the source of compressed air and with the pressure vessel and wherein the blasting medium and a stream of compressed air are mixed;

a nozzle connected to the conveying line and through which the mixture of compressed air and blasting medium are discharged;

an air line connecting the conveying line and the pressure vessel to the source of compressed air; and an exit line connecting the pressure vessel to the conveying line;

the improvement comprising:

a variable size orifice positioned within said exit line being adjustable to predetermined opening areas which restrict the flow of the blasting medium to regulate the flow rate consistent with the particle size of said blasting medium;

sensor means connected to the exit line and to the conveying line, for monitoring the pressure differential therebetween;

pressure regulator means responsive to said sensor means, wherein said pressure regulator means includes separate pressure vessel pressure regulator means in connection with the air line and conveying line pressure regulator means in connection with the conveying line, for regulating pressure within the pressure vessel and the conveying line and for maintaining a positive, preselected pressure differential between the pressure vessel and the conveying line.

8. The blasting method of claim 7, wherein said preselected pressure differential is between 1.0 and 5.0 psig.

9. The blasting method of claim 7, wherein said preselected pressure differential is between 2.0 and 4.0 psig.

10. The blasting method of claim 7, wherein said preselected pressure differential is selected to maintain a uniform flow rate through the nozzle.

11. The blasting method of claim 10, wherein said uniform flow rate is between 0.5 and 10.0 pounds per minute of blasting medium.

12. The blasting method of claim 7 wherein the sensor means monitors the pressure vessel at the exit line in connection therewith.

13. The blasting method of claim 7 wherein the blasting medium has a mean particle size of from about 250 to 300 microns.

14. The blasting method of claim 7 wherein the blasting medium is sodium bicarbonate.

15. The blasting method of claim 7 wherein said orifice positioned within said exit line has an opening corresponding to the area provided by circular orifices of from about 0.063 to 0.156 inch diameter.

16. The blasting method of claim 15 wherein said orifice has an opening corresponding to about a 0.125 inch opening and the blasting medium has a mean particle size of about 70 microns.

17. The blasting method of claim 35 wherein said orifice has an opening corresponding to about a 0.156 inch opening and the blasting medium has a mean particle size from about 250 to 300 microns.

* * * * *

UNITED STATES PATENT AND TRADEMARK OFFICE
CERTIFICATE OF CORRECTION

PATENT NO. : 5,081,799

DATED : January 21, 1992

INVENTOR(S): Lawrence Kirschner, et al.

It is certified that error appears in the above-identified patent and that said Letters Patent is hereby corrected as shown below:

Column 1, line 4, Change "application" to --Application--.

Column 1, line 5, Change "16" to --6--.

Column 5, line 9, In claim 8, change "method" to --apparatus--.

Column 5, line 12, In claim 9, change "method" to --apparatus--.

Column 5, line 14, In claim 10, change "method" to --apparatus--.

Column 5, line 19, In claim 11, change "method" to --apparatus--.

Column 6, line 1, In claim 12, change "method" to --apparatus--.

Column 6, line 4, In claim 13, change "method" to --apparatus--.

Column 6, line 7, In claim 14, change "method" to --apparatus--.

UNITED STATES PATENT AND TRADEMARK OFFICE

CERTIFICATE OF CORRECTION

PATENT NO. : 5,081,799

DATED : January 21, 1992

INVENTOR(S) : Lawrence Kirschner, et al.

It is certified that error appears in the above-identified patent and that said Letters Patent is hereby corrected as shown below:

Column 6, line 9, In claim 15, change "method" to --apparatus--.

Column 6, line 13, In claim 16, change "method" to --apparatus--.

Column 6, line 17, In claim 17, change "method" to --apparatus-- and change "35" to --15--.

Signed and Sealed this

Twenty-second Day of June, 1993

*Attest:*

Michael K. Kirk

MICHAEL K. KIRK

*Attesting Officer*

*Acting Commissioner of Patents and Trademarks*